US007471275B2

(12) United States Patent
Shieh et al.

(10) Patent No.: US 7,471,275 B2
(45) Date of Patent: Dec. 30, 2008

(54) LIQUID CRYSTAL DISPLAY DEVICE AND DRIVING METHOD OF THE SAME

(75) Inventors: Ya-Wen Shieh, Taoyuan County (TW); Liang-Hua Yeh, Taipei County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 796 days.

(21) Appl. No.: 10/908,640

(22) Filed: May 20, 2005

(65) Prior Publication Data

US 2006/0262071 A1 Nov. 23, 2006

(51) Int. Cl.
*G09G 3/36* (2006.01)

(52) U.S. Cl. ..... 345/98; 345/103

(58) Field of Classification Search ..... 345/87, 345/204, 98–100, 103
See application file for complete search history.

(56) References Cited

U.S. PATENT DOCUMENTS 5,870,070 A * 2/1999 Furukawa et al. ..... 345/99
6,040,814 A * 3/2000 Murakami et al. ..... 345/94
6,633,272 B1 * 10/2003 Kumagawa et al. ..... 345/98
7,253,810 B2 * 8/2007 Ito et al. ..... 345/204
2001/0011988 A1 * 8/2001 Ikeda et al. ..... 345/98
2003/0034948 A1 * 2/2003 Imamura ..... 345/98
2005/0253833 A1 * 11/2005 Teshirogi et al. ..... 345/204
2006/0119634 A1 * 6/2006 Otose ..... 347/19
2006/0187178 A1 * 8/2006 Sun ..... 345/100
2006/0192699 A1 * 8/2006 Azami et al. ..... 341/100
2006/0202923 A1 * 9/2006 Osada ..... 345/76
2007/0046614 A1 * 3/2007 Chien ..... 345/100

* cited by examiner

*Primary Examiner*—Ricardo L Osorio
(74) *Attorney, Agent, or Firm*—Jianq Chyun IP Office

(57) ABSTRACT

The invention is directed to a driving method for an LCD device, including conducting two of the gate driving lines respectively controlled by different gate integrated circuits. Then, it is determined that one of the two conducted gate driving lines is applied with the scan signal, according to a first output enabling signal and a second output enabling signal being received. A latch signal is received, wherein during a period at a high logic level of the latch signal, the adjacent source driving lines are shorted.

14 Claims, 6 Drawing Sheets

LIQUID CRYSTAL DISPLAY DEVICE AND DRIVING METHOD OF THE SAME

BACKGROUND OF THE INVENTION

1. Field of Invention

The present invention relates to a liquid crystal display (LCD) device and its driving method. More particularly, the present invention relates to an LCD device and its driving method, which can insert a black image in display without exporting a black signal to the displaying region.

2. Description of Related Art

The early applications of the thin-film transistor (TFT) LCD are usually on the notebook computer and terminal of personal computer. In this situation, most of the image signals are standstill image. In recent years, under the development by the LCD manufacturers, the liquid-crystal displaying technology has been gradually applied to the TFT-LCD in large size, and the image signals have changed from the standstill manner into dynamic manner. However, the current TFT-LCD is using the hold-type for display, that is, before the next set of data being written in, the pixels are held for display the current data. Thus, when this hold-type, of which the relation between the voltage and the timing is shown in FIG. 4, is operated in the dynamic image, it would cause a phenomenon of dragging image for the dynamic image.

Referring to FIG. 5, FIG. 5 is a circuit block, schematically illustrating a conventional LCD. The conventional LCD 500 includes a source driving circuit 502, a first gate integrated circuit 504, a second gate integrated circuit 506, a third gate integrated circuit 508 and a displaying region 510. Wherein, the displaying region 510 includes multiple image pixel block regions, formed from gate driving lines G1-G768 and source driving lines CH1-CH3072.

In the conventional technology, the first gate integrated circuit 504, the second gate integrated circuit 506, and the third gate integrated circuit 508 are receiving an output enabling signal. The output enabling signal includes a first output enabling signal, a second output enabling signal, and a third output enabling signal. The first output enabling signal controls the first gate integrated circuit 504, the second output enabling signal controls the second gate integrated circuit 506, and the third output enabling signal controls the third gate integrated circuit 508.

Referring to FIG. 5 and FIG. 6, in the conventional technology, after the gate driving line G1 being conducted, when the first output enabling signal is at the logic high, the scanning signal is not exported to the gate driving line G1. It is until the first output enabling signal is at the logic low, then the gate driving line G1 exports the scanning signal. After gate driving line G2 being conducted, when the first output enabling signal is at logic low, the scanning signal is then exported to the gate driving line G2. After gate driving line G3 being conducted, when the first output enabling signal is at logic low, the scanning signal is then exported to the gate driving line G3.

In summary, the current LCD device causes the phenomenon of dragging image due to a low speed for displaying image and an eye's image lag for a user.

SUMMARY OF THE INVENTION

The invention provides a driving method for the LCD device, which sets the gate driving lines, which are conducted but are not exporting with the scan signal, to a common voltage.

The invention provides an LCD device, which uses the charge sharing circuit, such that a black image can be inserted without applying the black signal.

The invention provides a driving method for an LCD device. The LCD device includes multiple gate driving lines, multiple source driving lines, a gate driving circuit, and a source driving circuit, wherein the gate driving circuit includes several gate integrated circuits. The driving method includes conducting two of the gate driving lines respectively controlled by different gate integrated circuits. Then, it is determined that one of the two conducted gate driving lines is applied with the scan signal, according to a first output enabling signal and a second output enabling signal being received. A latch signal is received, wherein during a period at a high logic level of the latch signal, the adjacent source driving lines are shorted.

In accordance with the foregoing embodiment of the invention, in the foregoing driving method, when the latch signal is at a high logic level, the adjacent two source driving lines are shorted.

In accordance with the foregoing embodiment of the invention, the gate driving lines without exporting the black signals are applied with a voltage equal to the common voltage.

The invention further provides an LCD device. The LCD device includes multiple gate driving lines, a gate driving circuit, multiple source driving lines, a source driving circuit. The gate driving circuit is coupled to the gate driving lines. The gate driving circuit includes multiple gate integrated circuits, and the gate integrated circuits are based on the received multiple output enabling signals to determine whether or not the scan signal is exported to one of the two conducted gate driving lines controlled by different gate driving circuits. The foregoing source driving circuit is coupled to the source driving lines. The source driving circuit includes multiple charge sharing circuits. These charge sharing circuits are determined, according to the latch signal, whether or not to electrically connect the adjacent two source driving lines. Wherein, these charge sharing circuits receive the latch signal, and the adjacent two source driving lines are shorted during the time period when the latch signal is at the logic high level.

In accordance with the embodiment of the invention, when the latch signal is at a low logic level, the charge sharing circuits are to open the adjacent two source driving lines.

Since the invention uses the charge sharing circuits, it is not necessary to export the black signal to the displaying region, and a black image can be inserted by applying a common voltage to the conducted gate driving lines, which do not export black signals. In addition, most of charging time can be saved for use by the normal signal. As a result, the phenomenon of insufficient charging is also reduced.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Figure 1A:
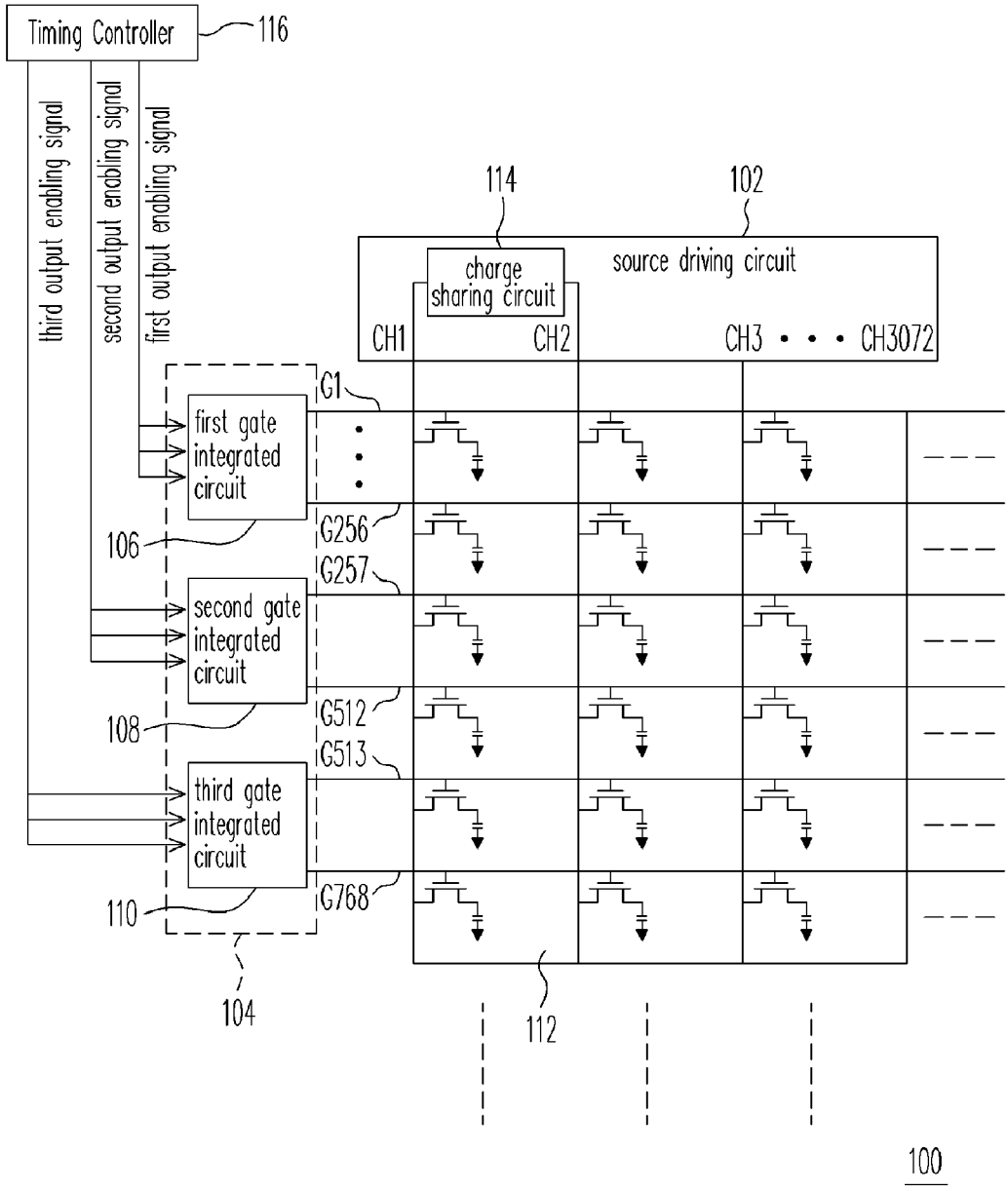
FIG. 1A is a block diagram, schematically illustrating a LCD device, according to a preferred embodiment of the invention.

Referring to FIG. 1A, FIG. 1A is a block diagram, schematically illustrating a LCD device, according to a preferred embodiment of the invention. The LCD device includes a source driving circuit 102, a gate driving circuit 104, and a displaying region 112. Wherein, the displaying region 112 includes, for example, the gate driving lines G1-G768, the source driving lines CH1-CH3072, so as to form a plurality of pixel blocks. Since the XGA type is taken as the example for descriptions, the number of the gate driving lines is 768 and the number of the source driving lines is 3072. However, it is not the only limitation in practical application.

In the embodiment, the gate driving circuit includes a gate integrated circuit 106, a second gate integrated circuit 108, and a third gate integrated circuit 110, and receives a first output enabling signal, a second output enabling signal, and a third output enabling signal, from a timing controller T-CON 116. The first gate integrated circuit 106 controls the gate driving lines G1-G256, the second gate integrated circuit 108 controls the gate driving lines G257-G512, the third gate integrated circuit 110 controls the gate driving lines G513-G768.

The source driving circuit 102 controls the source driving lines CH1-CH3072, and is implemented with a charge sharing circuit between adjacent two source driving lines.

Figure 2:
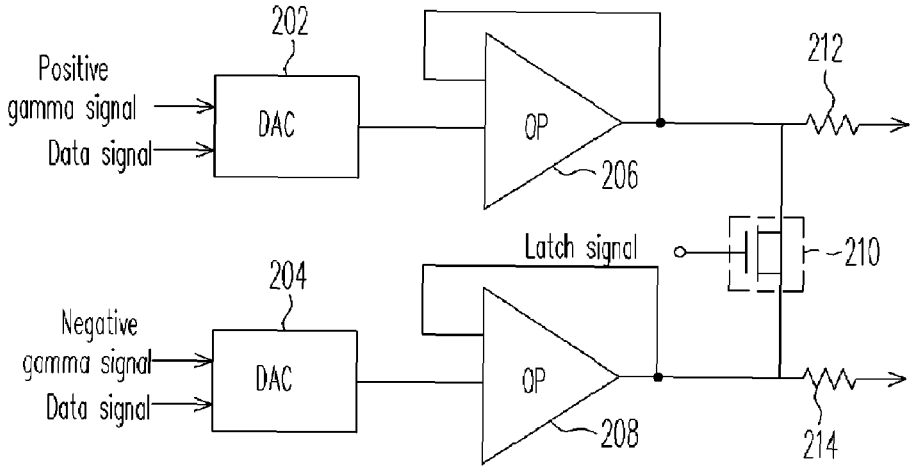
FIG. 2 is circuit diagram, schematically illustrating the inner circuit of a source driving circuit, according to a preferred embodiment of the invention.

Referring to FIG. 2, FIG. 2 is circuit diagram, schematically illustrating a source driving circuit, according to a preferred embodiment of the invention. The source driving circuit 102 includes digital-to-analog converters 202 and 204, operational amplifiers 206 and 208, charge sharing circuit 210 and resistors 212 and 214.

The digital-to-analog converter (DAC) 202 receives a positive gamma correction signal and a data signal. After conversion from digital to analog, the results are exported to operational amplifier 206. Likewise, the digital-to-analog converter 204 receives a negative gamma correction signal and a data signal. After conversion from digital to analog, the results are exported to operational amplifier 208.

One end of the charge sharing circuit 210 receives a latch signal, and the other two ends respectively coupled to the operational amplifier 206 and the operational amplifier 208. The resistor 212 is coupled between the source driving line and the output end of the operational amplifier 206. The resistor 214 is coupled between the source driving line and the output end of the operational amplifier 208. Wherein, it is determined whether or not the charge sharing circuit 210 is electrically coupled to the source driving line being coupled with the resistor 212 and the resistor 214, according to the latch signal.

In the embodiment of the invention, the charge sharing circuit 210 can be, for example, a MOS transistor but being not limited.

In the embodiment of the invention, any two gate driving lines respectively controlled by different integrated circuits are conducted at the same time. For example, when one of the conducted gate driving lines is coupled to the first gate integrated circuit 106, then the other one of the conducted gate driving lines can be any one of the gate driving lines being coupled to the second gate driving circuit 108 or any one of the gate driving lines being coupled to the third gate driving circuit 110.

Figure 1B:
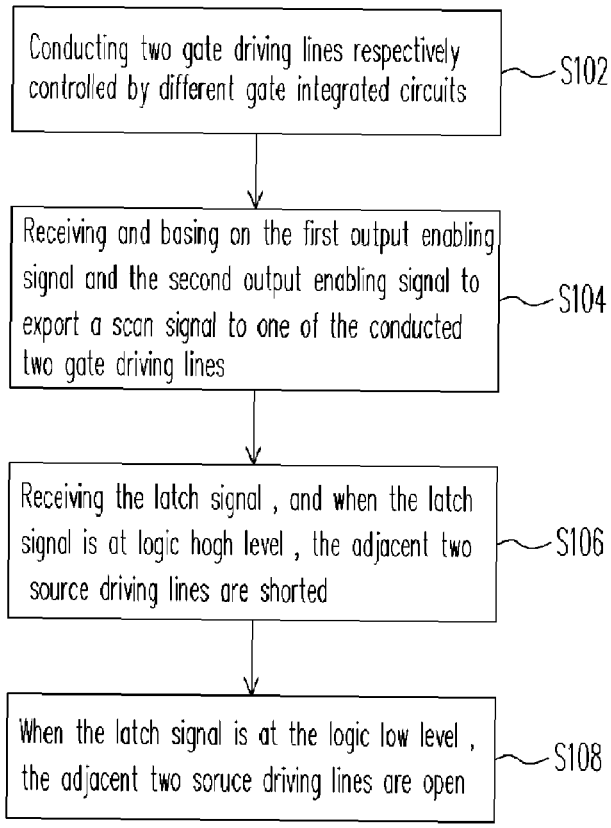
FIG. 1B is a flow diagram, schematically illustrating a driving method for an LCD device, according to a preferred embodiment of the invention.

Referring to FIG. 1A and FIG. 1B, for easy description, in the embodiment, the gate driving line G1 and G257 are taken as the example for description but it is not only limited.

In the embodiment, two gate driving lines G1 and G257 are conducted at the same time period, and the first output enabling signal and the second output enabling signal are used to respectively the first gate integrated circuit 106 and the second gate integrated circuit 108 (S102). When the first output enabling signal and the second output enabling signal are both at low logic level, the first gate integrated circuit 106 and the second gate integrated circuit 108 then export the scan signal. Therefore, when the first output enabling signal and the second output enabling signal are in opposite phase, as shown in FIG. 3 marked by the shaded portion of the gate driving lines G1 and G257, only one of the gate driving lines G1 and G257 can export the scan signal (S104).

Figure 3:
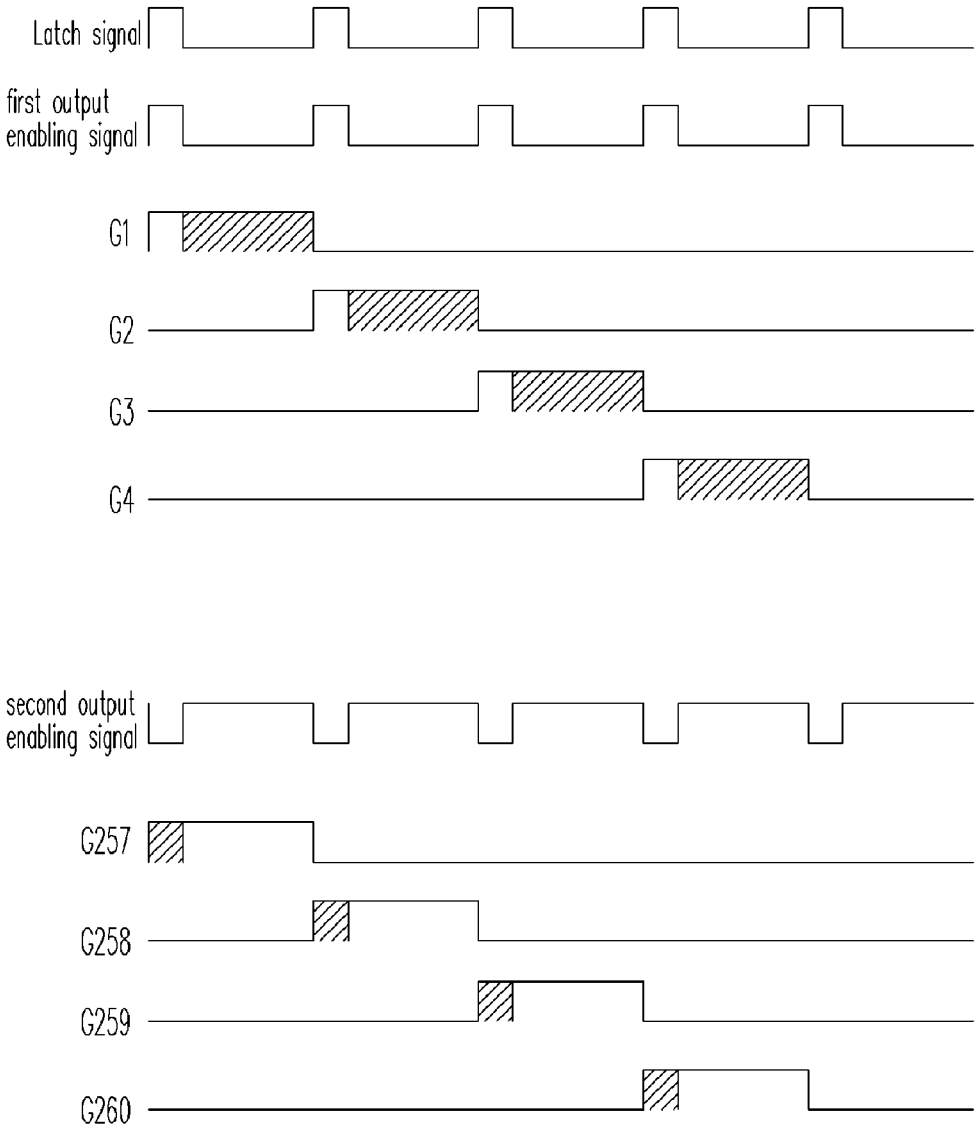
FIG. 3 is a drawing, schematically illustrating a waveform of signal in an LCD device, according to a preferred embodiment of the invention.
Figure 4:
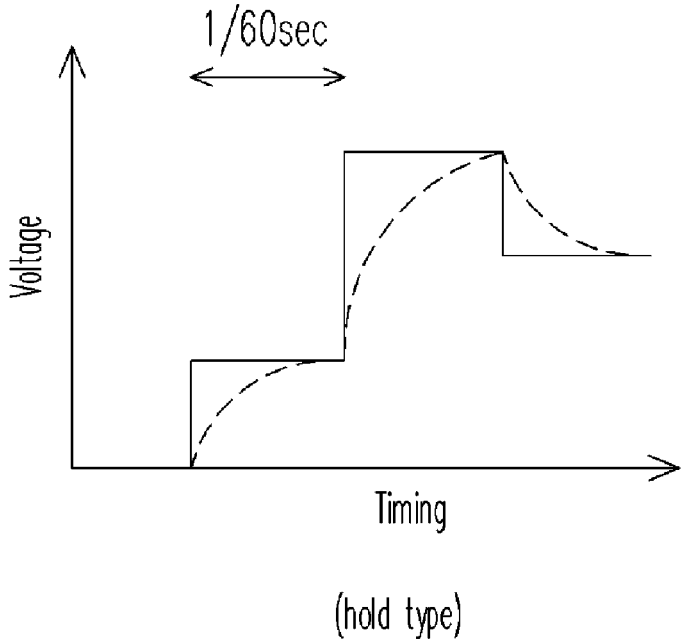
FIG. 4 (PRIOR ART)
FIG. 4 is a drawing, schematically illustrating a waveform of signal in a hold-type of the conventional LCD device.
Figure 4:
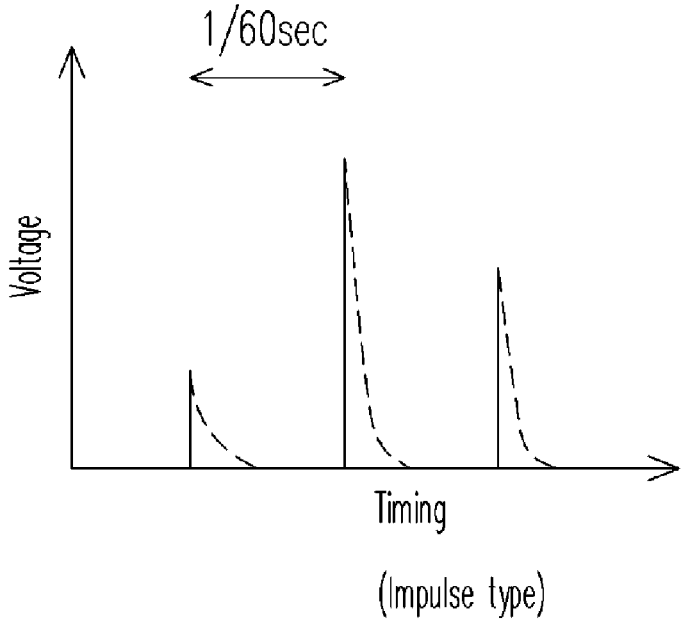
FIG. 4 (PRIOR ART)
Figure 5:
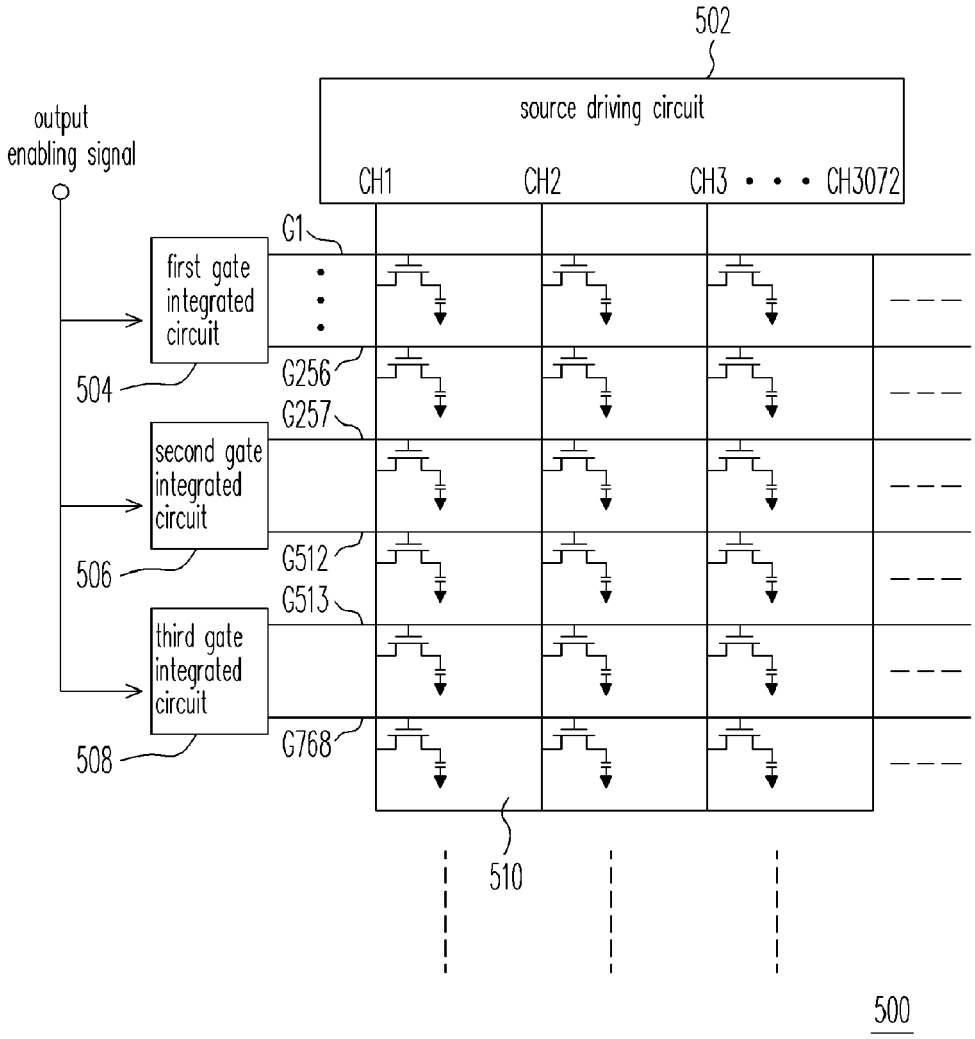
FIG. 5 (PRIOR ART)
FIG. 5 is a block diagram, schematically illustrating the circuit of a conventional LCD device.
Figure 6:
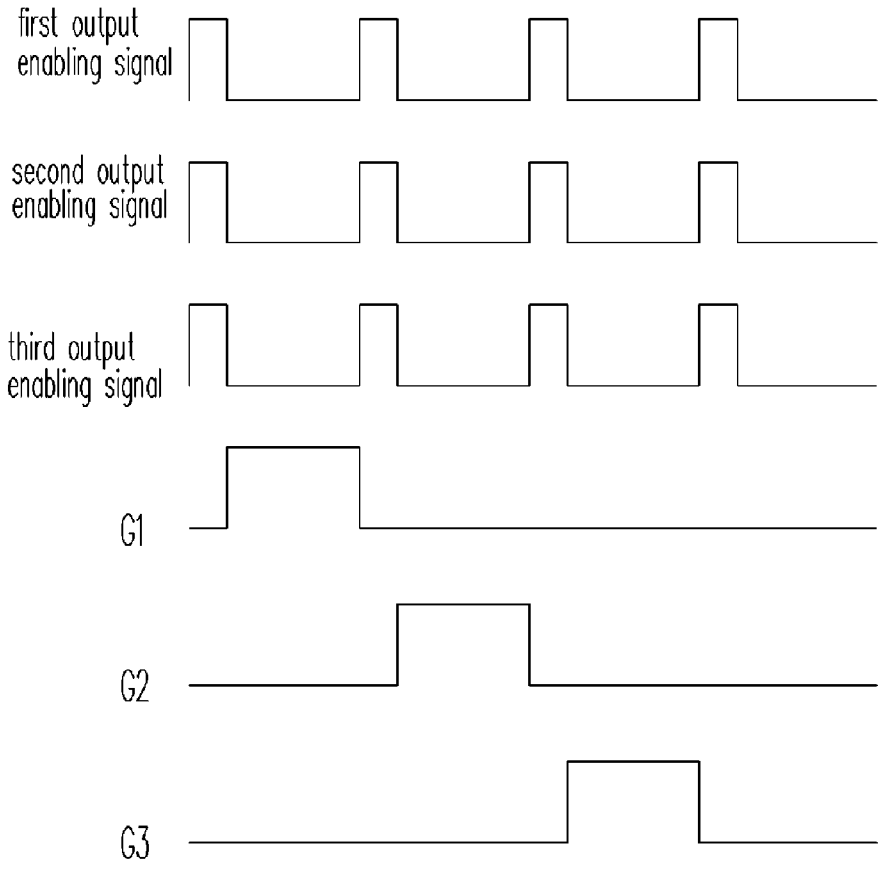
FIG. 6 (PRIOR ART)
FIG. 6 is a drawing, schematically illustrating a waveform of signal in a conventional LCD device.

Then, the polarity of the latch signal at the rising edge is used, so that during the width of the latch signal, as shown in FIG. 3 at the shaded portion of the gate driving line G257), the CH1 with CH2, CH3 with CH4, CH5 with CH6, . . . , CH3071 with CH3072 are shorted (S106). As a result, the positive and negative charges on the gate driving line G257 can be neutralized, and then the voltage is approaching to the common voltage Vcom.

Then, at the falling edge of the latch signal, as shown in FIG. 3 at the shaded portion of the gate driving line G1), the CH1 with CH2, CH3 with CH4, CH5 with CH6, . . . , CH3071 with CH3072 are open (S108), and then the source driving lines CH1-CH3072 can transmit the data signals. In this driving sequence, the way of CRT display with impulse type to insert the black image can be simulated to solve the phenomenon of dragging image in dynamic image.

In summary, in the LCD device and the driving method of the invention, since the use of the charge sharing circuit can allow the conducted gate driving lines without exporting the black signals, such as scan signals, to approach the common voltage. As a result, the function to insert a black image can be achieved without exporting a black signal to the displaying region. Also and, most of charging time can be saved for use by the normal signal. The phenomenon of insufficient charging is also reduced.

It will be apparent to those skilled in the art that various modifications and variations can be made to the structure of the present invention without departing from the scope or spirit of the invention. In view of the foregoing descriptions, it is intended that the present invention covers modifications and variations of this invention if they fall within the scope of the following claims and their equivalents.

What is claimed is:

1. A driving method of liquid crystal display (LCD) device, wherein the LCD device comprises a plurality of gate driving lines, a plurality of source driving lines, a gate integrated circuit, and a source driving circuit, the gate driving circuit include a plurality of gate integrated circuits, the driving method comprising:

conducting two of the gate driving lines, respectively controlled by the different gate integrated circuits;

receiving a first output enabling signal and a second output enabling signal, and determining whether or not exporting a scan signal to one of the two conducted gate driving lines, according to the first output enabling signal and the second output enabling signal; and receiving a latch signal, wherein when the latch signal is at a logic high level in a period, the adjacent two source driving lines are shorted.

2. The driving method of claim 1, further comprising opening the adjacent two source driving lines when the latch signal is at a logic low level in the period.

3. The driving method of claim 1, wherein the gate driving lines, which are not exporting black signals, is set to a common voltage.

4. The driving method of claim 1, wherein when the first output enabling signal is at the logic low level, the scan signal is then exported to the conducted gate driving lines.

5. The driving method of claim 1, wherein when the second output enabling signal is at the logic low level, the scan signal is then exported to the conducted gate driving lines.

6. The driving method of claim 1, wherein when the first output enabling signal is at the logic high level, the scan signal is not exported to the conducted gate driving lines.

7. The driving method of claim 1, wherein when the second output enabling signal is at the logic high level, the scan signal is not exported to the conducted gate driving lines.

8. A liquid crystal display (LCD) device, comprising:

a plurality of gate driving lines;

a gate driving circuit, coupled to the gate driving lines, the gate driving circuit comprising a plurality of gate integrated circuits, wherein the gate integrated circuits receives a plurality of output enabling signals, and determine whether or not to export a scan signal to one of the two gate driving lines being conducted and controlled by different gate integrated circuits, according to the output enabling signals;

a plurality of source driving lines; and a source driving circuit, coupled to the source driving lines, wherein the source driving circuit comprises a plurality of charge sharing circuits, the charge sharing circuits determine whether or not the adjacent source driving lines are electrically connected, according to a latch signal;

wherein when the charge sharing circuits receive the latch signal, then when the latch signal is at a logic high level in a period, the adjacent source driving lines are shorted.

9. The LCD device of claim 8, wherein when the latch signal is at a logic low level in a period, the charge sharing circuits open the adjacent two source driving lines.

10. The LCD device of claim 8, wherein each of the charge sharing circuits includes a transistor.

11. The LCD device of claim 8, wherein when the output enabling signals are at a logic low level in a period, the scan signal is exported to the conducted gate driving lines.

12. The LCD device of claim 8, wherein when the output enabling signals are at a logic high level, the scan signal is not exported to the conducted gate driving lines.

13. The LCD device of claim 12, wherein the gate driving lines, which are not exporting with black signals, are at a common voltage.

14. The LCD device of claim 8, further comprising a timing controller, coupled to the gate driving circuit, and exporting the output enabling signals.

* * * * *